US011821326B2

(12) United States Patent
Vanapalli et al.

(10) Patent No.: US 11,821,326 B2
(45) Date of Patent: Nov. 21, 2023

(54) TURBINE CONTAINMENT SYSTEM

(71) Applicant: General Electric Company, Schenectady, NY (US)

(72) Inventors: Veeraraju Vanapalli, Bangalore (IN); Bhaskar Nanda Mondal, Bangalore (IN); Apostolos Pavlos Karafillis, Winchester, MA (US); Kenneth E. Seitzer, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 17/241,242

(22) Filed: Apr. 27, 2021

(65) Prior Publication Data

US 2022/0341345 A1 Oct. 27, 2022

(51) Int. Cl.

| | |
|---|---|
| ***F01D 21/04*** | (2006.01) |
| ***F01D 25/12*** | (2006.01) |
| ***F01D 11/20*** | (2006.01) |

(52) U.S. Cl.

CPC ..... *F01D 21/045* (2013.01); *F01D 11/20* (2013.01); *F01D 21/04* (2013.01); *F01D 25/12* (2013.01); *F05D 2220/32* (2013.01)

(58) Field of Classification Search

CPC ..... F01D 11/20; F01D 21/04; F01D 21/045
See application file for complete search history.

(56) References Cited

U.S. PATENT DOCUMENTS

| | | | | |
|---|---|---|---|---|
| 4,534,698 | A | 8/1985 | Tomich | |
| 4,718,818 | A | 1/1988 | Premont | |
| 4,841,726 | A * | 6/1989 | Burkhardt | F01D 11/24 415/116 |
| 7,959,405 | B2 | 6/2011 | Launders | |
| 8,181,443 | B2 * | 5/2012 | Rago | F02C 7/12 60/226.3 |
| 8,186,933 | B2 * | 5/2012 | Doss | F01D 11/001 415/1 |
| 9,169,045 | B2 * | 10/2015 | Clark | F01D 11/125 |
| 9,598,978 | B2 | 3/2017 | Hoyland et al. | |
| 9,816,510 | B2 | 11/2017 | Harper | |
| 10,247,035 | B2 * | 4/2019 | Lefebvre | F16B 39/103 |
| 2017/0314416 | A1 | 11/2017 | Sharma et al. | |
| 2018/0066675 | A1 | 3/2018 | Kappes et al. | |
| 2018/0283204 | A1 | 10/2018 | Fracchia et al. | |
| 2018/0283205 | A1 | 10/2018 | Fracchia et al. | |
| 2019/0063460 | A1 | 2/2019 | Costa | |
| 2021/0107623 | A1 * | 4/2021 | Barrett | F01D 25/04 |

* cited by examiner

*Primary Examiner* — Courtney D Heinle
*Assistant Examiner* — John S Hunter, Jr.
(74) *Attorney, Agent, or Firm* — Dority & Manning, P.A.

(57) ABSTRACT

A turbine containment system is provided. The turbine containment system includes a first containment member surrounding a portion of a turbine including a plurality of rotor disks and rotor blades; and a second containment member in communication with the first containment member, wherein the first containment member and the second containment member together contain each of the rotor disks and the rotor blades therein.

16 Claims, 5 Drawing Sheets

TURBINE CONTAINMENT SYSTEM

FIELD

The present subject matter relates generally to a gas turbine engine, or more particularly to turbine containment systems.

BACKGROUND

Gas turbine engines include several sections that include rotating blades contained within engine housings such as a turbine casing. If a rotating blade breaks it must be contained within the engine housing. To ensure broken blades do not puncture the housing, the walls of the housing have been manufactured to be relatively thick and/or reinforced with metal or other suitable materials. Turbine casings rely on external piping systems to cool the casing, such as an active clearance control (ACC) external pipe arrangement to supply cooler air to outer surfaces of the engine case to help maintain proper temperature of the engine casing and provide proper turbine rotor/stator clearance during operation. The complexity of the external piping and ancillary piping tubes, brackets and valve, increases manufacturing costs and increases the engine's weight.

BRIEF DESCRIPTION

Aspects and advantages of the invention will be set forth in part in the following description, or may be obvious from the description, or may be learned through practice of the invention.

In one exemplary embodiment of the present disclosure, a turbine containment system is provided. The turbine containment system includes a first containment member surrounding a portion of a turbine including a plurality of rotor disks and rotor blades; and a second containment member in communication with the first containment member, wherein the first containment member and the second containment member together contain each of the rotor disks and the rotor blades therein.

In certain exemplary embodiments the first containment member is an active clearance control casing in communication with the turbine.

In certain exemplary embodiments the second containment member includes a Kevlar® (referred to hereinbelow simply as "Kevlar") wrap disposed over a portion of the active clearance control casing.

In certain exemplary embodiments the turbine containment system includes a shield including apertures on an interior surface of the shield, wherein the shield supports a portion of the second containment member.

In certain exemplary embodiments the turbine containment system includes a cooling air source in communication with the active clearance control casing and the shield, wherein a first flow of cooling fluid from the cooling air source is directed through the active clearance control casing and the apertures of the shield to the turbine.

In certain exemplary embodiments the apertures of the shield are positioned adjacent to the turbine in a radial direction.

In certain exemplary embodiments the turbine containment system includes a spoke mount connection between the active clearance control casing and the second containment member to control thermal movement therebetween.

In certain exemplary embodiments the first containment member surrounds the turbine along a longitudinal axis of the turbine containment system between a first end and a second end, and wherein a first thickness of the first containment member at the first end is different than a second thickness of the first containment member at the second end.

In certain exemplary embodiments the second containment member is a soft wall hoop member attached under a core cowl portion of a turbine engine to the turbine containment system.

In certain exemplary embodiments the soft wall hoop member is formed of an ultra-high-molecular-weight polyethylene material.

In certain exemplary embodiments the turbine containment system includes a high temperature hard wall casing disposed over the first containment member.

In certain exemplary embodiments the high temperature hard wall casing is formed of a titanium alloy material.

In certain exemplary embodiments the high temperature hard wall casing is attached under a core cowl portion of a turbine engine to the turbine containment system.

In another exemplary embodiment of the present disclosure, a turbine containment system is provided. The turbine containment system includes a first containment member surrounding a portion of a turbine including a plurality of rotor disks and rotor blades; a second containment member in communication with the first containment member; and a shield including apertures on an interior surface of the shield, wherein the shield supports a portion of the second containment member, wherein the first containment member and the second containment member together contain each of the rotor disks and the rotor blades therein.

In certain exemplary embodiments the turbine containment system includes a cooling air source in communication with the first containment member and the shield.

In certain exemplary embodiments a first flow of cooling fluid from the cooling air source is directed through the first containment member and the apertures of the shield to the turbine.

In certain exemplary embodiments the turbine containment system includes a spoke mount connection between the first containment member and the second containment member to control thermal movement therebetween.

In certain exemplary embodiments the first containment member surrounds the turbine along a longitudinal axis of the turbine containment system between a first end and a second end, and wherein a first thickness of the first containment member at the first end is different than a second thickness of the first containment member at the second end.

In certain exemplary embodiments the second containment member is a soft wall hoop member attached under a core cowl portion of a turbine engine to the turbine containment system.

In certain exemplary embodiments the turbine containment system includes a high temperature hard wall casing disposed over the first containment member.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Corresponding reference characters indicate corresponding parts throughout the several views. The exemplifications set out herein illustrate exemplary embodiments of the disclosure, and such exemplifications are not to be construed as limiting the scope of the disclosure in any manner.

DETAILED DESCRIPTION

Figure 1:
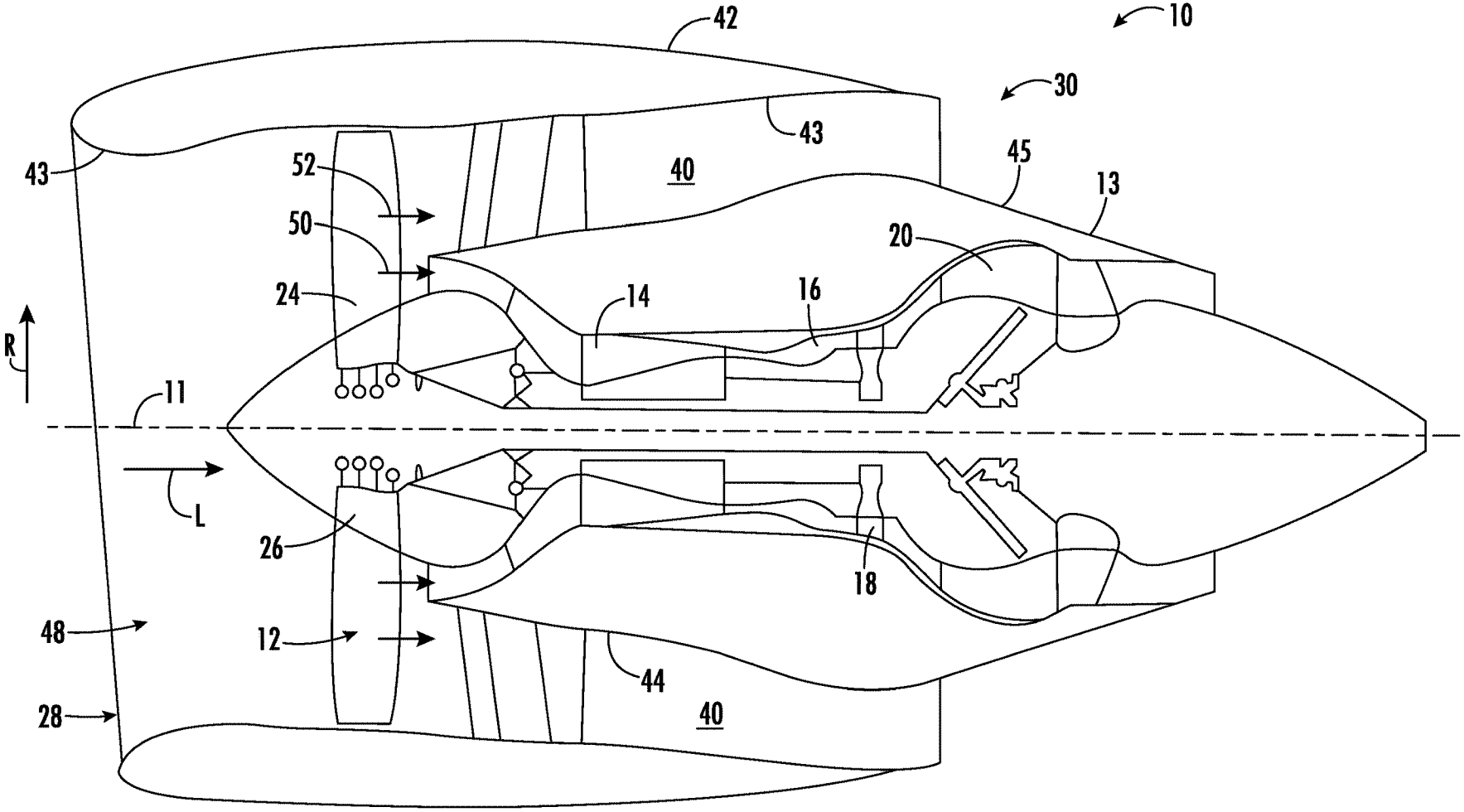
FIG. 1 is a schematic, cross-sectional view of an exemplary gas turbine engine in accordance with exemplary embodiments of the present disclosure.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

The following description is provided to enable those skilled in the art to make and use the described embodiments contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

For purposes of the description hereinafter, the terms "upper", "lower", "right", "left", "vertical", "horizontal", "top", "bottom", "lateral", "longitudinal", and derivatives thereof shall relate to the invention as it is oriented in the drawing figures. However, it is to be understood that the invention may assume various alternative variations, except where expressly specified to the contrary. It is also to be understood that the specific devices illustrated in the attached drawings, and described in the following specification, are simply exemplary embodiments of the invention. Hence, specific dimensions and other physical characteristics related to the embodiments disclosed herein are not to be considered as limiting.

As used herein, the terms "first", "second", and "third" may be used interchangeably to distinguish one component from another and are not intended to signify location or importance of the individual components.

The terms "forward" and "aft" refer to relative positions within a gas turbine engine, with forward referring to a position closer to an engine inlet and aft referring to a position closer to an engine nozzle or exhaust.

The terms "upstream" and "downstream" refer to the relative direction with respect to fluid flow in a fluid pathway. For example, "upstream" refers to the direction from which the fluid flows, and "downstream" refers to the direction to which the fluid flows.

The singular forms "a", "an", and "the" include plural references unless the context clearly dictates otherwise.

Additionally, the terms "low," "high," or their respective comparative degrees (e.g., lower, higher, where applicable) each refer to relative speeds within an engine, unless otherwise specified. For example, a "low-pressure turbine" operates at a pressure generally lower than a "high-pressure turbine." Alternatively, unless otherwise specified, the aforementioned terms may be understood in their superlative degree. For example, a "low-pressure turbine" may refer to the lowest maximum pressure turbine within a turbine section, and a "high-pressure turbine" may refer to the highest maximum pressure turbine within the turbine section.

Approximating language, as used herein throughout the specification and claims, is applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a ten percent margin. Here and throughout the specification and claims, range limitations are combined and interchanged, such ranges are identified and include all the sub-ranges contained therein unless context or language indicates otherwise.

Here and throughout the specification and claims, range limitations are combined and interchanged, such ranges are identified and include all the sub-ranges contained therein unless context or language indicates otherwise. For example, all ranges disclosed herein are inclusive of the endpoints, and the endpoints are independently combinable with each other.

A turbine containment system of the present disclosure includes a first containment member and a second containment member in communication with the first containment member that together protectively surround a portion of a turbine or turbine assembly. It is envisioned that the turbine containment system of the present disclosure can protectively surround an LP turbine, an HP turbine, or other turbine configurations. In an exemplary embodiment, the turbine assembly includes a plurality of rotor disks that each include a rotor blade coupled thereto.

The turbine containment system of the present disclosure protectively surrounds a portion of a turbine or turbine assembly such that the first containment member and the second containment member together contain each of the rotor disks and the rotor blades therein. For example, rotary parts of a turbine assembly, e.g., LP turbine, may be subjected to high centrifugal forces which may cause the bursting of rotors, e.g., rotor blades and rotor disks together, due to high stresses or due to manufacturing defects. The present invention by utilizing both the first containment member and the second containment member together are able to effectively contain both the rotor blades and the rotor disks therein.

Referring now to the drawings, wherein identical numerals indicate the same elements throughout the figures, FIG. 1 is a schematic cross-sectional view of a gas turbine engine in accordance with an exemplary embodiment of the present disclosure. More particularly, for the embodiment of FIG. 1, the exemplary gas turbine engine 10 has a longitudinal axis 11 that defines a longitudinal direction L and a radial direction R that extends radially outward from the longitudinal axis 11. Gas turbine engine 10 includes a fan assembly 12, and a core gas turbine engine 13. Core gas turbine engine 13 includes a high pressure compressor 14, a combustor 16, and a high pressure turbine 18. In the exemplary embodiment, gas turbine engine 10 may also include a low pressure turbine 20. Fan assembly 12 includes an array of fan blades 24 extending radially outward from a rotor disk 26. Engine 10 has an intake side 28 and an exhaust side 30. Gas turbine engine 10 also includes a plurality of bearing assemblies (not shown) that are utilized to provide rotational and axial support to fan assembly 12, compressor 14, high pressure turbine 18 and low pressure turbine 20, for example.

In operation, an inlet airflow 48 flows through fan assembly 12 and is split by an airflow splitter 44 into a first portion 50 and a second portion 52. First portion 50 of the airflow is channeled through compressor 14 wherein the airflow is further compressed and delivered to combustor 16. Hot products of combustion from combustor 16 are utilized to drive turbines 18 and 20 and thus produce engine thrust. Gas turbine engine 10 also includes a bypass duct 40 that is utilized to bypass a second portion 52 of the airflow discharged from fan assembly 12 around core gas turbine engine 13. More specifically, bypass duct 40 extends between an inner wall 43 of a fan casing or shroud 42 and an outer wall 45 of splitter 44.

Figure 2A:
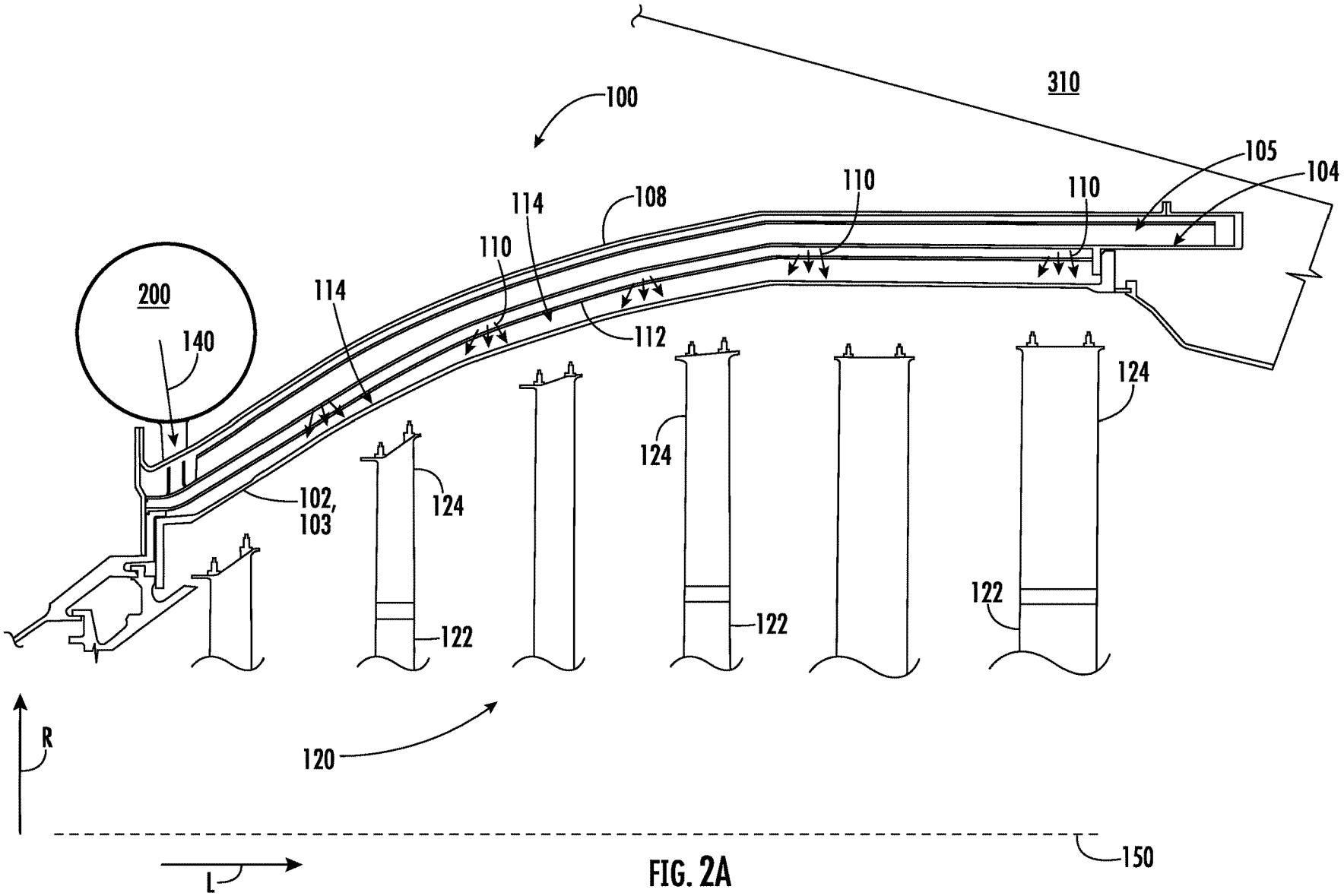
FIG. 2A is a cross-sectional view of a turbine containment system in accordance with an exemplary embodiment of the present disclosure.

FIGS. 2A-5 illustrate exemplary embodiments of the present disclosure. Referring to FIGS. 2A-2B, in an exemplary embodiment, a turbine containment system 100 that may be used with the exemplary gas turbine engine 10 shown in FIG. 1. The turbine containment system 100 includes a first containment member 102 and a second containment member 104. Referring to FIG. 2A, the first containment member 102 and the second containment member 104 surrounds the turbine assembly 120 along a longitudinal axis 150 of the turbine containment system 100.

As shown in FIG. 2A, the first containment member 102 and the second containment member 104 in communication with the first containment member 102 protectively surround a portion of a turbine or turbine assembly 120. It is envisioned that the turbine containment system 100 of the present disclosure can protectively surround an LP turbine 20 (FIG. 1). It is further contemplated that the turbine containment system 100 of the present disclosure can protectively surround an HP turbine 18 (FIG. 1), or other turbine configurations. In an exemplary embodiment, the turbine assembly 120 includes a plurality of rotor disks 122 that each include a rotor blade 124 coupled thereto.

The first containment member 102 and the second containment member 104 in communication with the first containment member 102 protectively surround a portion of a turbine or turbine assembly 120 such that the first containment member 102 and the second containment member 104 together contain each of the rotor disks 122 and the rotor blades 124 therein.

In an exemplary embodiment, the first containment member 102 is an active clearance control casing (ACC) 103 in communication with the turbine assembly 120 to supply cooler air to the surfaces of the engine case.

Furthermore, in an exemplary embodiment, the second containment member 104 of the turbine containment system 100 may also include a Kevlar wrap 105 disposed over a portion of the active clearance control casing 103. It is contemplated that the Kevlar wrap 105 may include a variable number of wraps of Kevlar 105 disposed over a portion of the active clearance control casing 103 for particular applications. As will be appreciated, Kevlar is a para-aramid synthetic fiber known to be heat-resistant and lightweight, and to have a high tensile strength.

Figure 2B:
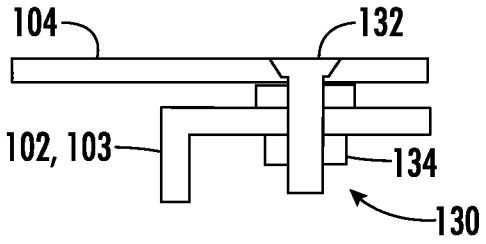
FIG. 2B is an exploded, cross-sectional view of a connection system of a turbine containment system in accordance with an exemplary embodiment of the present disclosure.

Referring to FIGS. 2A and 2B, in an exemplary embodiment, the first containment member 102 and the second containment member 104 in communication with the first containment member 102 protectively surround a portion of a turbine or turbine assembly 120 such that the first containment member 102 and the second containment member 104 together contain each of the rotor disks 122 and the rotor blades 124 therein. For example, the second containment member 104 may cover and surround the first containment member 102. In other exemplary embodiments, the second containment member 104 may be in communication with the first containment member 102 in other configurations, e.g., in a series or parallel connected configuration to together contain each of the rotor disks 122 and the rotor blades 124 therein.

Referring to FIG. 2B, in an exemplary embodiment, the turbine containment system 100 further includes a connection system 130 between the first containment member 102 and the second containment member 104 to secure the second containment member 104 to the first containment member 102 and to control thermal movement therebetween. Referring to FIG. 2B, the connection system 130 includes a first connection member 132 and a second connection member 134. In such a manner, the connection system 130 provides a mechanism to secure the second containment member 104 to the first containment member 102 to protectively surround a portion of a turbine or turbine assembly 120 such that the first containment member 102 and the second containment member 104 together contain each of the rotor disks 122 and the rotor blades 124 therein. It is envisioned that the connection system 130 may comprise a spoke mount connection system between the active clearance control casing 103 and the second containment member 104 to control thermal movement therebetween and to securely connect the components theretogether.

The turbine containment system 100 of the present disclosure protectively surrounds a portion of a turbine or turbine assembly 120 such that the first containment member 102 and the second containment member 104 together contain each of the rotor disks 122 and the rotor blades 124 therein. For example, rotary parts of a turbine assembly 120, e.g., LP turbine 20 (FIG. 1), may be subjected to high centrifugal forces which may cause the bursting of rotors, e.g., rotor blades and rotor disks together, due to high stresses or due to manufacturing defects. The present invention by utilizing both the first containment member 102 and the second containment member 104 together are able to effectively contain both the rotor blades and the rotor disks therein.

Referring to FIG. 2A, in an exemplary embodiment, the turbine containment system 100 further includes a shield 108 including apertures 110 on an interior surface 112 of the shield 108. The shield 108 is configured to provide internal apertures 110 as part of a flowpath for active clearance control casing air supply to the engine casing and also as a supporting member that is able to support a portion of the second containment member 104. In an exemplary embodiment, the apertures 110 of the shield 108 are positioned adjacent to the turbine assembly 120 in a radial direction, although other configurations are envisioned to supply a flow of cool air to the turbine assembly 120.

Referring to FIG. 2A, in an exemplary embodiment, the turbine containment system 100 includes a cooling air source 200 in communication with the first containment member 102 and the shield 108. The cooling air source 200 provides a first flow of cooling fluid 140 from the cooling air source 200 that is directed through the first containment member 102, e.g., the active clearance control casing 103, and the apertures 110 of the shield 108 to the turbine assembly 120.

In one exemplary embodiment, the cooling air source 200 from which a flow of cooling air 140 is extracted and channeled along an integral cooling duct 114 within the first containment member 102. In some embodiments, the cooling air source 200 is bypass air 52 from bypass duct 40 of engine 10 (FIG. 1). In other embodiments, the cooling air source 200 is fan air 48 from fan assembly 12 of engine 10 (FIG. 1). In other embodiments, the cooling air source 200 is fan air 50 from fan assembly 12 of engine 10 (FIG. 1). In other exemplary embodiments, the cooling air source 200 is air from high pressure compressor 14 or may be from other components of engine 10. Generally, the cooling air source 200 is any air source from outside core 13 that provides low temperature, low or high pressure air to turbine containment system 100. The use of such air in turbine containment system 100 minimizes the effect of removing a portion of the air from other engine 10 systems and therefore minimizes the effect on engine 10 performance. It is contemplated that cooling air source 200 may also come from other systems of engine 10.

Figure 5:
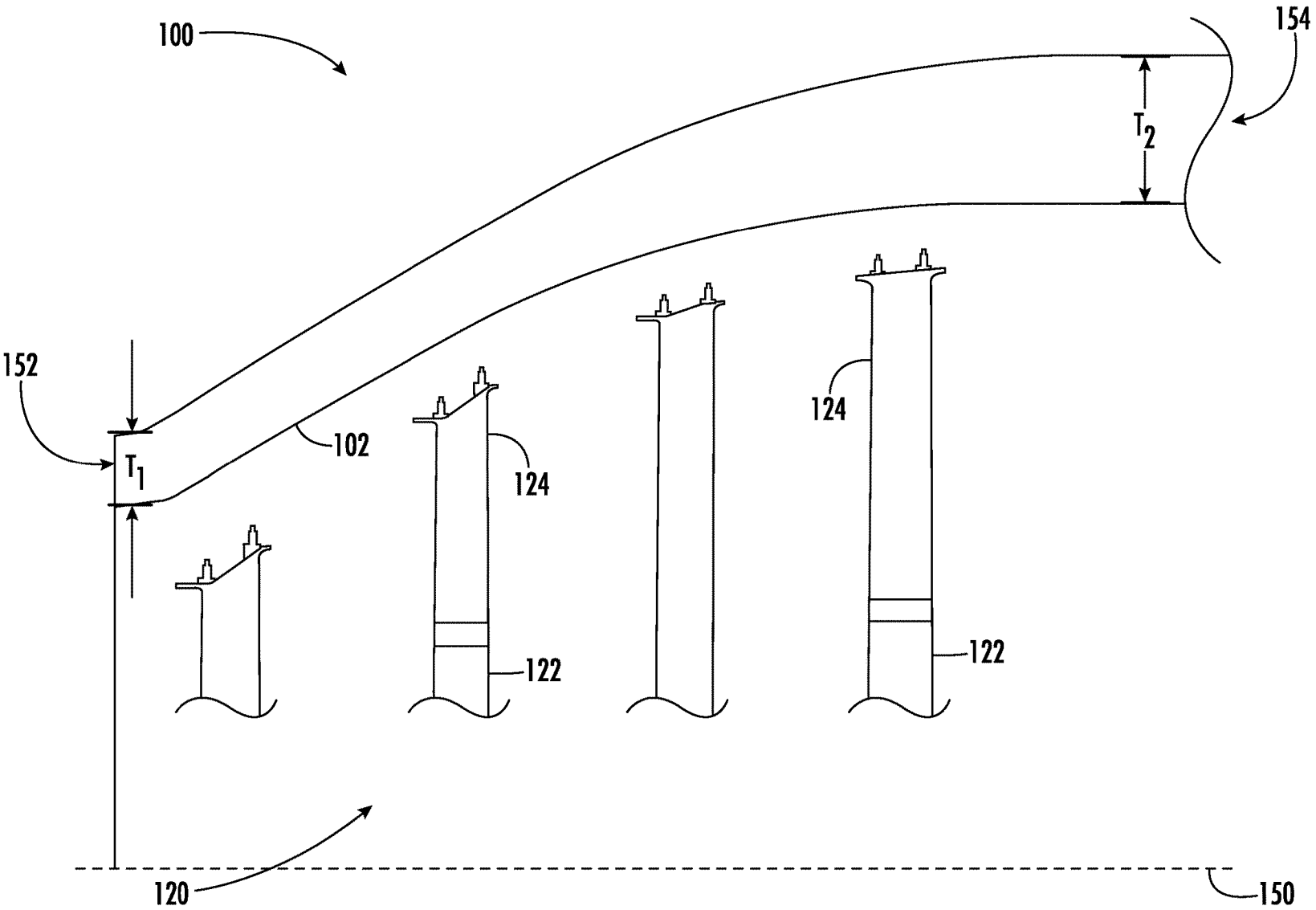
FIG. 5 is a cross-sectional view of a first containment member of a turbine containment system having a variable thickness configuration in accordance with an exemplary embodiment of the present disclosure.

Referring to FIG. 5, in an exemplary embodiment, the turbine containment system 100 of the present disclosure includes a first containment member 102 that surrounds the turbine assembly 120 along a longitudinal axis 150 of the turbine containment system 100 between a first end 152 and a second end 154, and wherein a first thickness T1 of the first containment member 102 at the first end 152 is different than a second thickness T2 of the first containment member 102 at the second end 154. For example, the second thickness T2 of the first containment member 102 may be greater than the first thickness T1 of the first containment member 102 as shown in FIG. 5. In other exemplary embodiments, it is envisioned that the first thickness T1 of the first containment member 102 may be greater than the second thickness T2 of the first containment member 102. In further exemplary embodiments, it is envisioned that other variable thickness configurations of the first containment member 102 may be utilized, such as a reduced thickness portion of the first containment member 102 between two greater thickness portions at the first end 152 and the second end 154 respectively, or other variable thickness configurations for other applications. It is envisioned that such variable thickness configurations of the first containment member 102 along a case length may be based on kinetic energy from rotor disks 122 and rotor blades 124 at different stages of the turbine assembly 120. It is also contemplated that the second containment member 104 and the Kevlar 105 may also include variable thickness configurations as described with the first containment member 102.

Figure 3:
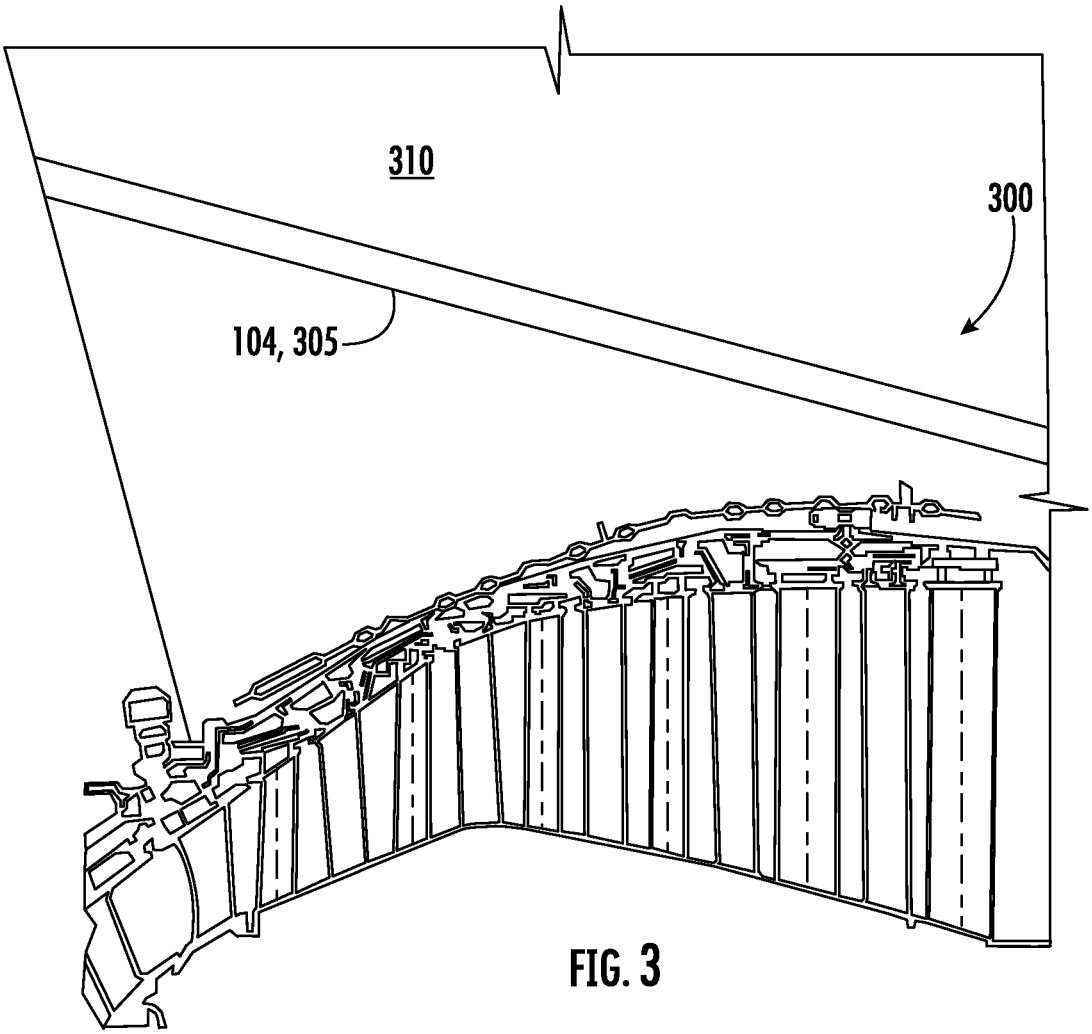
FIG. 3 is a cross-sectional view of a turbine containment system in accordance with another exemplary embodiment of the present disclosure.

FIG. 3 illustrates another exemplary embodiment of the present disclosure. Referring to FIG. 3, a turbine containment system 300 of the present disclosure includes the second containment member 104 being a soft wall hoop member 305 that is attached under a core cowl portion 310 of a turbine engine 10 (FIG. 1) and to the turbine containment system 300.

In such an embodiment, the soft wall containment member as a hoop member 305 may be formed of Kevlar, a composite material, or formed of an ultra-high-molecular-weight polyethylene material.

Figure 4:
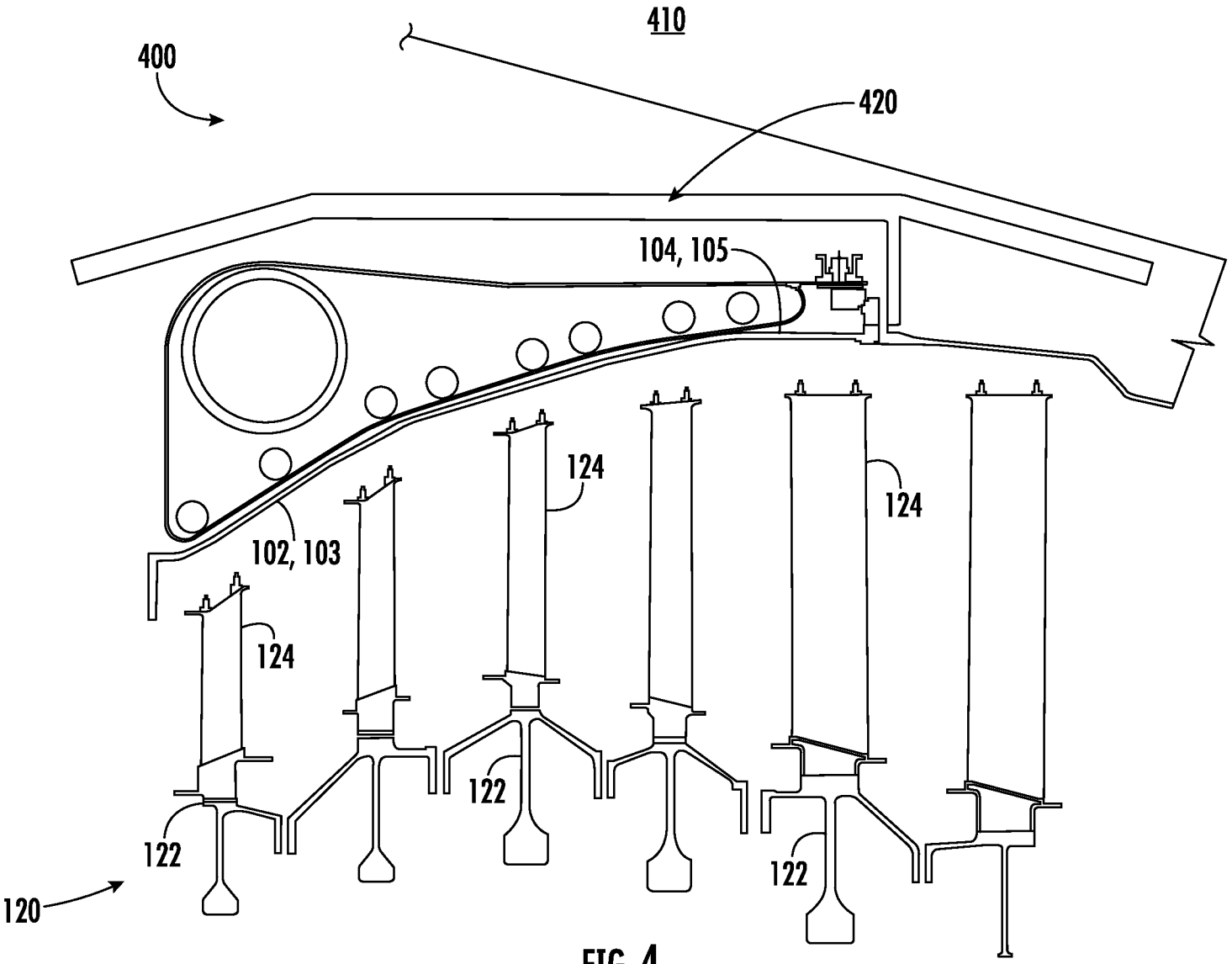
FIG. 4 is a cross-sectional view of a turbine containment system in accordance with another exemplary embodiment of the present disclosure.

FIG. 4 illustrates another exemplary embodiment of the present disclosure. Referring to FIG. 4, a turbine containment system 400 of the present disclosure further includes a high temperature hard wall casing 420 that is disposed over the first containment member 102. In other exemplary embodiments, it is envisioned that the high temperature hard wall casing 420 may be disposed over each of the first containment member 102 and the second containment member 104.

In an exemplary embodiment, the high temperature hard wall casing 420 that is disposed over the first containment member 102 is attached under a core cowl portion 410 of a turbine engine 10 (FIG. 1) and to the turbine containment system 400.

In such an embodiment, the high temperature hard wall casing 420 may be formed of a high temperature capable polymer matrix composite (PMC) material. It is also contemplated that the high temperature hard wall casing 420 may be formed of other high temperature capable materials such as a titanium alloy material, a steel alloy material, a nickel alloy material, or other similar alloy material.

The turbine containment systems of the present disclosure protectively surround a portion of a turbine or turbine assembly such that the first containment member and the second containment member together contain each of the rotor disks and the rotor blades therein. For example, rotary parts of a turbine assembly, e.g., LP turbine, may be subjected to high centrifugal forces which may cause the bursting of rotors, e.g., rotor blades and rotor disks together, due to high stresses or due to manufacturing defects. The present invention by utilizing both the first containment member and the second containment member together are able to effectively contain both the rotor blades and the rotor disks therein.

Further aspects of the invention are provided by the subject matter of the following clauses:

1. A turbine containment system, comprising: a first containment member surrounding a portion of a turbine including a plurality of rotor disks and rotor blades; and a second containment member in communication with the first containment member, wherein the first containment member and the second containment member together contain each of the rotor disks and the rotor blades therein.

2. The turbine clearance control system of any preceding clause, wherein the first containment member is an active clearance control casing in communication with the turbine.

3. The turbine clearance control system of any preceding clause, wherein the second containment member includes a Kevlar wrap disposed over a portion of the active clearance control casing.

4. The turbine clearance control system of any preceding clause, further comprising a shield including apertures on an interior surface of the shield, wherein the shield supports a portion of the second containment member.

5. The turbine clearance control system of any preceding clause, further comprising a cooling air source in communication with the active clearance control casing and the shield, wherein a first flow of cooling fluid from the cooling air source is directed through the active clearance control casing and the apertures of the shield to the turbine.

6. The turbine clearance control system of any preceding clause, wherein the apertures of the shield are positioned adjacent to the turbine in a radial direction.

7. The turbine clearance control system of any preceding clause, further comprising a spoke mount connection between the active clearance control casing and the second containment member to control thermal movement therebetween.

8. The turbine clearance control system of any preceding clause, wherein the first containment member surrounds the turbine along a longitudinal axis of the turbine containment system between a first end and a second end, and wherein a first thickness of the first containment member at the first end is different than a second thickness of the first containment member at the second end.

9. The turbine clearance control system of any preceding clause, wherein the second containment member is a soft wall hoop member attached under a core cowl portion of a turbine engine to the turbine containment system.

10. The turbine clearance control system of any preceding clause, wherein the soft wall hoop member is formed of an ultra-high-molecular-weight polyethylene material.

11. The turbine clearance control system of any preceding clause, further comprising a high temperature hard wall casing disposed over the first containment member.

12. The turbine clearance control system of any preceding clause, wherein the high temperature hard wall casing is formed of a titanium alloy material.

13. The turbine clearance control system of any preceding clause, wherein the high temperature hard wall casing is attached under a core cowl portion of a turbine engine to the turbine containment system.

14. A turbine containment system, comprising: a first containment member surrounding a portion of a turbine including a plurality of rotor disks and rotor blades; a second containment member in communication with the first containment member; and a shield including apertures on an interior surface of the shield, wherein the shield supports a portion of the second containment member, wherein the first containment member and the second containment member together contain each of the rotor disks and the rotor blades therein.

15. The turbine clearance control system of any preceding clause, further comprising a cooling air source in communication with the first containment member and the shield.

16. The turbine clearance control system of any preceding clause, wherein a first flow of cooling fluid from the cooling air source is directed through the first containment member and the apertures of the shield to the turbine.

17. The turbine clearance control system of any preceding clause, further comprising a spoke mount connection between the first containment member and the second containment member to control thermal movement therebetween.

18. The turbine clearance control system of any preceding clause, wherein the first containment member surrounds the turbine along a longitudinal axis of the turbine containment system between a first end and a second end, and wherein a first thickness of the first containment member at the first end is different than a second thickness of the first containment member at the second end.

19. The turbine clearance control system of any preceding clause, wherein the second containment member is a soft wall hoop member attached under a core cowl portion of a turbine engine to the turbine containment system.

20. The turbine clearance control system of any preceding clause, further comprising a high temperature hard wall casing disposed over the first containment member.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

While this disclosure has been described as having exemplary designs, the present disclosure can be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains and which fall within the limits of the appended claims.

What is claimed is:

1. A turbine containment system, comprising:

a first containment member surrounding a portion of a turbine including a plurality of rotor disks and a plurality of rotor blades; and a second containment member in communication with the first containment member, wherein the first containment member and the second containment member together contain each of the plurality of rotor disks and the plurality of rotor blades therein;

wherein the first containment member is an active clearance control casing in communication with the turbine, and wherein the second containment member includes a para-aramid synthetic fiber wrap disposed over a portion of the active clearance control casing, and wherein the turbine containment system includes a connection assembly between the active clearance control casing and the second containment member to control thermal movement therebetween, wherein the connection assembly includes a first connection member and a second connection member, wherein the first connection member extends between the first containment member and the second containment member, and wherein the second connection member is positioned at least partially between the first containment member and the second containment member to provide an offset spacing of the second containment member from the first containment member.

2. The turbine containment system of claim 1, further comprising a shield including apertures on an interior surface of the shield, wherein the shield supports a portion of the second containment member.

3. The turbine containment system of claim 2, further comprising a cooling air source in communication with the active clearance control casing and the shield, wherein a first flow of cooling fluid from the cooling air source is directed through the active clearance control casing and the apertures of the shield to the turbine during operation of a gas turbine engine incorporating the turbine containment system.

4. The turbine containment system of claim 2, wherein the apertures of the shield are positioned adjacent to the turbine in a radial direction.

5. The turbine containment system of claim 1, wherein the first containment member surrounds the turbine along a longitudinal axis of the turbine containment system between a first end and a second end, and wherein a first thickness of the first containment member at the first end is different than a second thickness of the first containment member at the second end.

6. The turbine containment system of claim 1, wherein the second containment member is a soft wall hoop member attached under a core cowl portion of a turbine engine to the turbine containment system.

7. The turbine containment system of claim 6, wherein the soft wall hoop member is formed of an ultra-high-molecular-weight polyethylene material.

8. The turbine containment system of claim 1, further comprising a high temperature hard wall casing disposed over the first containment member.

9. The turbine containment system of claim 8, wherein the high temperature hard wall casing is formed of a titanium alloy material.

10. The turbine containment system of claim 8, wherein the high temperature hard wall casing is attached under a core cowl portion of a turbine engine to the turbine containment system.

11. A turbine containment system, comprising:

a first containment member surrounding a portion of a turbine including a plurality of rotor disks and a plurality of rotor blades;

a second containment member in communication with the first containment member; and a shield including apertures on an interior surface of the shield, wherein the shield supports a portion of the second containment member, wherein the first containment member and the second containment member together contain each of the plurality of rotor disks and the plurality of rotor blades therein;

wherein the first containment member is an active clearance control casing in communication with the turbine, and wherein the second containment member includes a para-aramid synthetic fiber wrap disposed over a portion of the active clearance control casing, and wherein the turbine containment system includes a connection assembly between the first containment member and the second containment member to control thermal movement therebetween, wherein the connection assembly includes a first connection member and a second connection member, wherein the first connection member extends between the first containment member and the second containment member, and wherein the second connection member is positioned at least partially between the first containment member and the second containment member to provide an offset spacing of the second containment member from the first containment member.

12. The turbine containment system of claim 11, further comprising a cooling air source in communication with the first containment member and the shield.

13. The turbine containment system of claim 12, wherein a first flow of cooling fluid from the cooling air source is directed through the first containment member and the apertures of the shield to the turbine during operation of a gas turbine engine incorporating the turbine containment system.

14. The turbine containment system of claim 11, wherein the first containment member surrounds the turbine along a longitudinal axis of the turbine containment system between a first end and a second end, and wherein a first thickness of the first containment member at the first end is different than a second thickness of the first containment member at the second end.

15. The turbine containment system of claim 11, wherein the second containment member is a soft wall hoop member attached under a core cowl portion of a turbine engine to the turbine containment system.

16. The turbine containment system of claim 11, further comprising a high temperature hard wall casing disposed over the first containment member.

* * * * *